United States Patent [19]

Takeshima et al.

[11] 4,286,648

[45] Sep. 1, 1981

[54] APPARATUS FOR OPERATING AN INJECTION CYLINDER OF A MOLDING MACHINE

[75] Inventors: Takahiko Takeshima; Motozo Kawashima; Masayuki Nishimoto, all of Ube, Japan

[73] Assignee: Ube Industries, Ube, Japan

[21] Appl. No.: 168,389

[22] Filed: Jul. 10, 1980

[30] Foreign Application Priority Data

Sep. 27, 1979 [JP] Japan ..... 54-123166

[51] Int. Cl.[3] ..... B22D 17/30

[52] U.S. Cl. ..... 164/312; 74/520; 74/106; 74/107

[58] Field of Search ..... 164/113, 119, 120, 303, 164/312–315, 133, 136, 137, 339, 342, 343, 341; 74/520, 106, 107; 425/574, 585, 586

[56] References Cited

U.S. PATENT DOCUMENTS

| | | | |
|---|---|---|---|
| 1,222,786 | 4/1917 | Morris | 164/120 |
| 4,088,178 | 5/1978 | Ueno et al. | 164/314 |

*Primary Examiner*—Robert D. Baldwin
*Assistant Examiner*—K. Y. Lin
*Attorney, Agent, or Firm*—Charles E. Pfund

[57] ABSTRACT

Apparatus for moving an injection cylinder of a molding machine between an injection position and a teeming position comprises a drive means, a link mechanism disposed between a pin on the side of the injection cylinder and a stationary pin secured to a lower platen so as to be expanded and collapsed by the drive means, a cam plate secured to oppose the side of the injection cylinder and provided with guide slot comprised of a longitudinal slot parallel with the axis of the injection cylinder when it is in the injection position and an inclined slot contiguous with the longitudinal slot, a first roller mounted on the side of the injection cylinder to be moved along the guide slot in accordance with the operation of the link mechanism, a guide member including a guide slot for moving the injection cylinder in the axial direction at the injection position, and a second roller positioned in the guide slot to act as a center of swinging of the injection cylinder.

8 Claims, 3 Drawing Figures

APPARATUS FOR OPERATING AN INJECTION CYLINDER OF A MOLDING MACHINE

BACKGROUND OF THE INVENTION

This invention relates to apparatus for operating an injection cylinder of such molding machines as a die cast machine, squeeze casting machine and a molten metal forging machine, and more particularly an injection cylinder operating apparatus in which movement of an injection cylinder and an injection sleeve in the axial direction and swinging or tilting thereof between a teeming position and an injection position are effected by a single drive means.

Heretofore, a vertical type die cast machine, such as disclosed in Ueno et al U.S. Pat. No. 4,088,178 issued on May 9, 1978 and assigned to the same assignee of this application, has been used. In the die cast machine disclosed therein, for the purpose of separating an injection sleeve at the tip of an injection cylinder away from the lower surface of a stationary metal mold or die and then tilting the injection sleeve to a teeming position, there are provided a drive means for vertically moving the injection sleeve and an independent drive means for tilting the injection sleeve together with the injection cylinder so as to perform the tilting of the injection sleeve and the docking operation in two steps. For this reason, the mechanical construction, the oil pressure circuit and the electric sequence circuit are relatively complicated. Moreover, the interval between the teeming and the starting of the injection is relatively long so that ever when the injection sleeve is electrically heated, the temperature of the molten metal tends to decrease, thus degrading the quality of the die cast products.

SUMMARY OF THE INVENTION

Accordingly, it is an object of this invention to provide an improved apparatus for operating an injection cylinder of a molding machine which is simple in construction and capable of reducing the interval between teeming and the starting of the injection.

Another object of this invention is to provide an improved injection cylinder operating apparatus being capable of effecting the tilting of the injection sleeve and the engagement thereof against the stationary metal mold by one operation by using a single drive means.

According to this invention, in a molding machine of the type comprising spaced apart first and second stationary platens, a stationary die secured to the first platen, an movable die which cooperates with the stationary die to mold molten metal, and injection cylinder disposed between the first and second stationary platens, for driving an injection plunger, and an injection sleeve disposed in front of the injection cylinder, wherein the molten metal is injected when axes of the injection cylinder and of the stationary and movable dies align with each other, and the molten metal is teemed into the injection cylinder when the axis of the injection cylinder is out of alignment with the axes of the stationary and movable dies, there is provided an apparatus for moving the injection cylinder between the injection position and the teeming position, characterized in that the apparatus comprises a drive means, a link mechanism disposed between a pin on the side of the injection cylinder and a stationary pin secured to the second platen so as to be expanded and collapsed by the drive means, a cam plate secured to oppose the side of the injection cylider and including a guide slot comprised of a longitudinal slot parallel with the axis of the injection cylinder when it is in the injection position and an inclined slot contiguous with the longitudinal slot, a first roller seccured to the side of the injection cylinder to be movable along the guide slot, a guide member provided with a slot for moving the injection cylinder in the axial direction in the injection position, and a second roller positioned in the slot of the guide member to act as a center of swinging motion of the injection cylinder.

DESCRIPTION OF THE PREFERRED EMBODIMENTS

Figure 1:
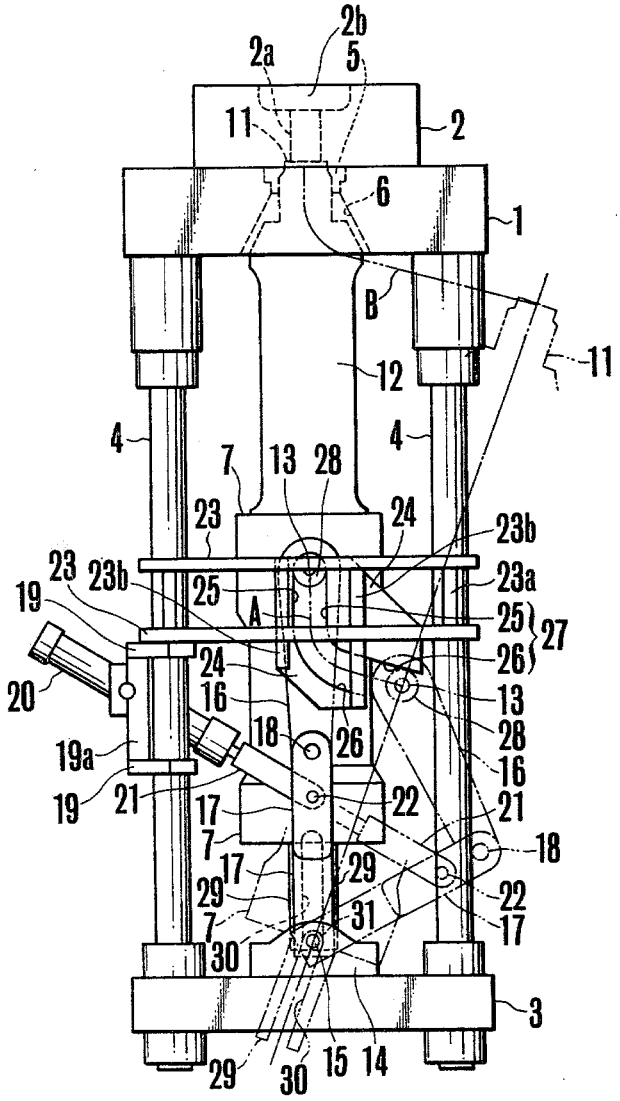
FIG. 1 is a side view of one embodiment of this invention.
Figure 2:
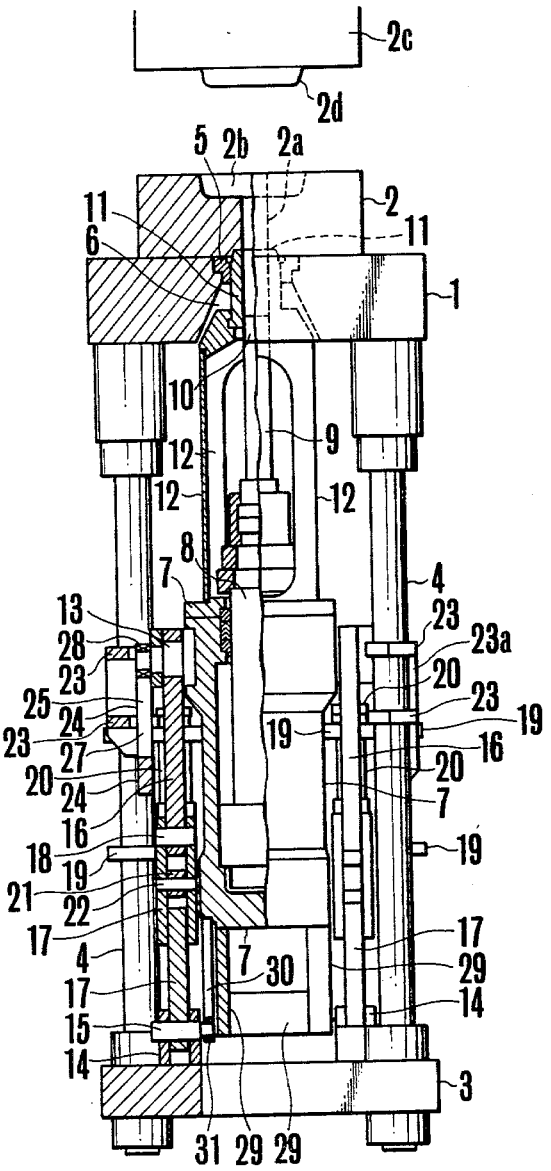
FIG. 2 is a front view of the embodiment of this invention, with the left hand portion depicted in section.

The injection cylinder operating apparatus of this invention shown in FIGS. 1 and 2 and utilized for a molding machine, particularly a vertical type die cast machine comprises a horizontal platen 1 on which a stationary metal mold or die 2 is mounted, a lower horizontal platen 3, four columns 4 interconnecting the upper and lower platens 1 and 3, a guide member 5 secured to the central upper portion of the upper platen 1 formed with a recess 6 at the center. The injection device further comprises an injection cylinder 7, a piston rod 8 reciprocable therein, and an injection plunger 9 intergrally formed with the piston rod 8 at the upper end thereof, a plunger tip 10, and an injection sleeve 11 secured to the injection cylinder 7 through a frame or connecting member 12. The plunger tip 10 is normally positioned in the injection sleeve 11. Along the central axis of the stationary metal mold 2 is formed a molten metal passage **2*a* through which the molten metal is passed at the time of injection, the upper end of the opening terminating in a recess 2*b*. A movable metal mold 2*c* provided above the stationary metal mold is moved in the vertical direction by a well known operating mechanism, not shown. As is well known in the art, the movable metal mold 2*c* and the stationary metal mold 2 are clamped to mold the molten metal which is pushed up by the plunger tip 10 and which prevails in a cavity defined by the recess 2*b* and die portion 2*d*. For the purpose of simplicity of illustration, the movable metal mold 2*c* is not shown in FIGS. 1 and 3**.

Pins 13 are secured to the upper portion on both sides of the injection cylinder 7, and stationary pins 15 are secured to brackets 14 secured to the lower platen 3. Links 16 are pivotally connected, at one end, to the pins 13, while links 17 are pivotally connected, at one end, to the stationary pins 15. The common junction of the links 16 and 17 is pivotally connected to a pin 18. As shown in FIGS. 1 and 2, the lefthand (as viewed in FIG. 1) two columns 4 are connected together by upper and lower beams 19 bridged by brackets **19*a*. A drive means in the form of a trunion type cylinder 20 mounted to each of the brackets 19*a* drives a link mechanism including links 16 and 17. The fore end of a piston rod 21 of the cylinder 20 is pivoted on a pin 22 secured to a portion of the link 17 through a pin 22. In this manner, each of the paired link mechanisms, collapsed and expanded by the drive means 20, is provided between the pin 13 on one side of the injection cylinder 7 and the stationary pin 15 secured to the lower platen 3 behind the injection cylinder 7 such that when the link mechanism is expanded to bring the links 16 and 17 into alignment as shown at solid lines in FIG. 1**, the injection cylinder is brought to a vertical or injection position.

Upper and lower beams 23 bridged by members 23*a* connect together two columns 4 on the right hand or left hand side as seen in FIG. 2, and a cam plate 24 is secured to a central portion of the paired beams 23 by means of supports 23*b* on each side of the injection cylinder. As shown by solid lines in FIG. 1, the cam plate 24 is provided with a longitudinal slot 25 extending in parallel with the axis of the injection cylinder 7 when it is in the injection position, and an inclined slot 26 which is contiguous with the longitudinal slot 25 through an arcuate slot. The inclined slot 26 inclines downwardly and is directed opposite to the cylinder 20, the slots 25 and 26 constituting a guide slot 27. A first roller 28 is coaxilly mounted on the tip of the pin 13 to be movable along the guide slot 27. Instead of being mounted on the pin 13, the roller 28 may be mounted on another pin (not shown). Of course the diameter of the roller 28 is made to be substantially equal to the width of the longitudinal slot 25.

A bracket 29 is secured to the bottom of the injection cylinder 7 and a guide member is provided for the bracket 29, the guide member having a guide slot 30 which guides the head of the injection cylinder 7 toward the axis of the injection cylinder 7 at the injection position, the upper end of the guide slot 30 acting as the center of swinging of the injection cylinder 7. A second roller 31 is coaxially mounted on the inner end of the stationary pin 15 for operating the link 17, the second roller 31 being received in a guide slot 30. When the roller 31 reaches the upper end of the guide slot 30, the injection cylinder swings about the roller 31.

Figure 3:
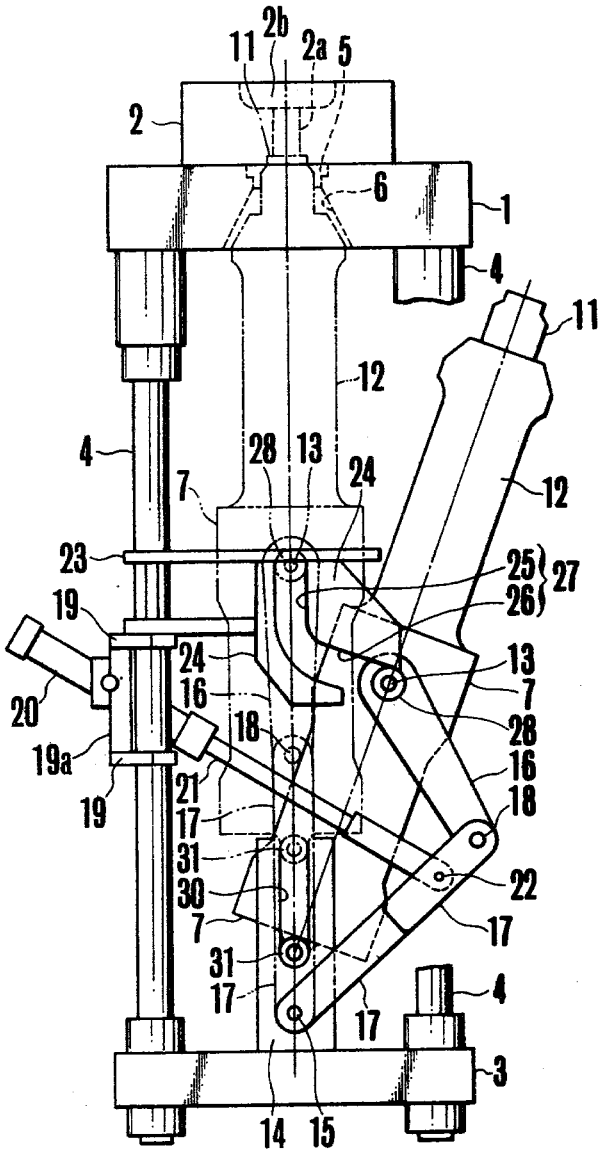
FIG. 3 is a side view showing a modified embodiment of this invention.

Although in the embodiment shown in FIGS. 1 and 2, the roller 31 is made to be stationary, and the guide member including the guide slot 30 is secured to the injection cylinder, this construction may be modified as shown in FIG. 3.

In the modified embodiment shown in FIG. 3, only the second roller 31 is provided beneath the head of the injection cylinder, a guide member including a vertical slot 30 is provided for bracket 14 secured to the lower platen 3 and the roller 31, is positioned in the guide slot 30. In this case too, the roller 31 acts as the center of the swinging motion of the injection cylinder 7, and the stationary pin 15 for operating the link 17 is positioned at the bottom of the guide slot 30 of the bracket 14. In FIG. 3, elements corresponding to those shown in FIGS. 1 and 2 are designated by the same reference numerals. However, the relative positions of the injection cylinder and links 16 and 17 shown by solid and dot and dach lines in FIG. 1 are reversed in FIG. 3.

To tilt the injection cylinder 7 and the injection sleeve 11 from the injection position shown by solid lines in FIG. 1 to the teeming position shown by the dot and dash lines, the piston rods 21 of the cylinders 20 are advanced to drive the link mechanism. Then the links 16 and 17 are collapsed. At this time, since the roller 28 mounted on each side of the injection cylinder 7 is located in the longitudinal slot 25 so that the roller 28 is restricted to move along the longitudinal slot 25. Also the lower roller 31 is held in the vertical slot 30 of the bracket 29 beneath the injection cylinder 7 so that the lower roller 31 is restricted to move along the slot 30. As a consequence, at the initial state, the injection cylinder 7 lowers while being maintained in the vertical position, thus separating the injection sleeve 11 away from the stationary metal mold 2.

When the injection cylinder 7 is slightly lowerd by the advance of the piston rod 21 and the collapse of the links 16 and 17, the injection cylinder 17 continues to move down by its own weight. As the roller 28 enters the curved portion of the guide slot 27, the injection cylinder 7 begins to tilt, and when it is brought to a position near a point where the roller 28 disengages, the lower guide surface of the cam plate 24 and the upper end of the guide slot 30 is brought to the position of the roller 31, the injection cylinder 7 tilts about the roller 31 to a position shown by dot and dash lines in FIG. 1. At this time, the centers of the rollers 28 and the upper surface of the injection sleeve 11 move along dotted line locus A shown in FIG. 1. When the injection cylinder 7 and the injection sleeve 11 completely tilt, the molten metal can be poured into the injection sleeve 11.

To restore the injection cylinder 7 to the original position for engaging the injection sleeve 11 against the stationary metal mold 2, the piston rod 21 at the limit of its forward movement is retracted. Then, an operation opposite to that described above is performed. Thus, the injection cylinder 7 is rotated in the counterclockwise direction as viewed in FIG. 1 about the roller 31 with the result that the roller 28 moves along the inclined guide slot 26 of the cam plate 24 and then enters into the longitudinal slot 25. Since at this time, the piston rod 21 continues to retract, the roller 28 begins to move upwardly in the longitudinal slot 25, and the guide slot 30 which has been brought back to the vertical position will also begin to move upwardly by being guided by the roller 31. Consequently, the injection cylinder 7 and the injection sleeve 11 move upwardly in the vertical posture until the injection sleeve 11 finally engages the stationary metal mold 2 to enable injection molding.

As described above, according to this invention, since the axial movement and the tilting of the injection cylinder is effected by using the link mechanisms, the cam plats and two rollers, there are the following advantages.

(1) With the prior art apparatus, the tilting of the injection cylinder and the engagement of the injection sleeve against the stationary metal mold are effected by two independent device means. But according to this invention, these two motions are effected by a driving means of one type and with one step, so that the pressure air circuit as well as electric sequence circuit can be simplified.

(2) It is always possible to permanently connect the injection sleeve to the injection cylinder, thus simplifying the construction of the structure between the injection sleeve and the piston rod end of the injection cylinder.

(3) As it is possible to decrease the interval between teeming of the molten metal and the starting of the injection, the decrease in the temperature of the molten metal can be minimized, thus improving the quality of the die cast product.

(4) After the injection sleeve has engaged the metal die, the injection sleeve is decelerated due to the characteristics of the link mechanisms. Accordingly, there is no fear of shock and splash of poured molten metal.

(5) In the injection position wherein the injection cylinder is held in vertical posture, the links are aligned to lock the injection cylinder, whereby the injection sleeve will not retract thus assuring safe and positive operation.

(6) When the sleeve is engaged against the metal mold, the link mechanism increases the force necessary for engagement, and it is possible to decrease the output of the cylinder.

(7) As it is possible to exchange the injection sleeve and the plunger tip at the inclined position, it is not necessary to dismount the metal mold. With the prior art apparatus, when the plunger tip is protruded, the injection sleeve also moves together therewith whereas in the apparatus of this invention, as these two members are integrally connected together, there is no such problem.

(8) As it is possible to construct the injection unit to be compact, the pit for installing the injection device may be shallow.

(9) Since the mounting portion of the injection sleeve is compact, it is possible to decrease the size of the recess formed in the upper platen so that the rigidity of the platen can be increased.

Although in the foregoing description the invention was applied to a vertical type die cast machine, it will be appreciated that the invention is also applicable to a horizontal type die cast machine in which a movable metal mold is moved by a horizontal type mold clamper in the horizontal direction to engage a stationary metal mold, and in which the molten metal is injected vertically from the lower extension of the engagement plane.

What is claimed is:

1. In a molding machine of the type comprising spaced apart first and second stationary platens, a stationary die secured to said first platen, a movable die which cooperates with the stationary die to mold molten metal, an injection cylinder disposed between the second stationary platen and the stationary and movable die for driving an injection plunger, and an injection sleeve disposed in front of the injection cylinder, said injection plunger being slidable in said injection sleeve, wherein the molten metal is injected when axes of the injection cylinder and of the molten metal passage align with each other, and the molten metal is teemed into the injection cylinder when the axis of the injection cylinder is out of alignment with the axes of the stationary and movable dies, an apparatus for moving the injection cylinder between the injection position and the teeming position, which comprises:

a drive means (20);

a link mechanism (16,17) disposed between a first pin (13) on the side of the injection cylinder (7) and a stationary second pin (15) secured to the second platen (3) so as to be expanded and collaped by the drive means (2);

a cam plate (24) secured to oppose the side of the injection cylinder and including a guide slot (27) comprised of a longitudinal slot (25) parallel with the axis of the injection cylinder when it is in the injection position and an inclined slot (26) contiguous with the longitudinal slot;

a first roller (28) secured to the side of the injection cylinder (7) to be movable along the guide slot (27);

a guide member provided with a slot (30) for moving the injection cylinder in the axial direction in the injection position; and a second roller (31) positioned in the slot of the guide member to act as a center of swinging motion of the injection cylinder.

2. The apparatus as defined in claim 1 wherein the injection sleeve is mounted in front end of the injection cylinder through a frame and a tip of the injection plunger is normally inserted into the injection sleeve.

3. The apparatus according to claim 1 wherein the guide member is secured to a lower end of the injection cylinder.

4. The injection apparatus according to claim 1 wherein the guide member is secured to the second stationary platen.

5. The apparatus according to claim 1 wherein the first and second stationary platens are interconnected by a plurality of columns (4), a bracket (23) is secured between the columns and the cam plate (24) is secured to the bracket.

6. The apparatus according to claim 1 wherein the first roller is coaxial with the first pin (13).

7. The apparatus according to claim 1 wherein the second roller is coaxial with the stationary second pin (15).

8. The apparatus according to claim 1 wherein said link mechanism comprises a first link (16) with one end pivotally connected to the first pin (13), and second link (17) with one end pivotally connected to the second pin (15) and wherein the other ends of the first and second links are interconnected by a third pin and the second drive means is connected to the second link.

* * * * *